US005192113A

United States Patent [19]

Wiecek

[11] Patent Number: 5,192,113

[45] Date of Patent: Mar. 9, 1993

[54] UPHOLSTERY TENSION ADJUSTMENT LINKAGE MECHANISM

[75] Inventor: Glenn N. Wiecek, Shelbyville, Ky.

[73] Assignee: Leggett & Platt, Incorporated, Carthage, Mo.

[21] Appl. No.: 573,468

[22] Filed: Aug. 27, 1990

[51] Int. Cl.[5] ..... A47C 1/02

[52] U.S. Cl. ..... 297/85; 297/68

[58] Field of Search ..... 297/85, 84, 89, 68, 297/218

[56] References Cited

U.S. PATENT DOCUMENTS

| | | | |
|---|---|---|---|
| 27,645 | 3/1860 | McGregor . | |
| 78,304 | 5/1868 | Martin . | |
| 1,248,931 | 12/1917 | Schuman . | |
| 3,103,381 | 9/1963 | Schliephacke . | |
| 3,550,952 | 12/1970 | Ferguson . | |
| 3,873,152 | 3/1975 | Galas | 297/68 |
| 3,980,335 | 9/1976 | Marhefka | 297/68 X |
| 4,249,772 | 2/1981 | Rogers, Jr. | 297/68 X |
| 4,410,213 | 10/1983 | Samson . | |
| 4,570,996 | 2/1986 | Rogers, Jr. . | |
| 4,577,902 | 3/1986 | Crum . | |
| 4,662,673 | 5/1987 | Crum . | |
| 4,669,778 | 6/1987 | Rogers, Jr. . | |
| 4,863,215 | 9/1989 | Crum | 297/68 X |
| 4,878,710 | 11/1989 | Tackor | 297/68 |
| 4,915,444 | 4/1990 | Rogers, Jr. . | |
| 5,000,510 | 3/1991 | Lafer | 297/68 X |

FOREIGN PATENT DOCUMENTS

| | | | |
|---|---|---|---|
| 598504 | 5/1934 | Fed. Rep. of Germany | 297/84 |
| 359259 | 5/1938 | Italy | 297/84 |

OTHER PUBLICATIONS

Hall, Jr., Allen S., "Kinematics & Linkage Design", 1961, pp. 1-10.

*Primary Examiner*—Jose V. Chen

*Attorney, Agent, or Firm*—Wood, Herron & Evans

[57] ABSTRACT

An adjusting tension adjustment linkage mechanism which enables a standard three-position recliner chair to be converted to a recliner lounger wherein a continuous upholstered cushion extending between the chair seat and the footrest may be maintained in a taut state in all positions of the footrest.

20 Claims, 2 Drawing Sheets

UPHOLSTERY TENSION ADJUSTMENT LINKAGE MECHANISM

BACKGROUND OF THE INVENTION

1. Field of Invention

This invention relates generally to action chairs having a movable footrest associated with the chair seat. More specifically, this invention relates to two or three position recliner chairs of the type which comprise a seat, backrest and footrest which are movable between upright or closed position, TV position in which the seat and backrest are partially reclined and the footrest extended, and fully reclined position in which the seat and backrest are fully reclined and the footrest extended.

2. Description of the Prior Art

Many action chairs have an extendible footrest which is movable from a retracted position located closely adjacent the front of the seat of the chair in a generally vertical orientation to an extended position spaced forward of the seat of the chair and in a generally horizontal attitude. Such traditional action or recliner chairs customarily have a cushion located on the chair seat, and a separate cushion attached to the footrest, with each cushion being covered separately with an overlying layer of upholstery. Therefore, when the recliner chair is used in the reclined position with the footrest extended, the user's legs in the location between the chair seat and footrest are generally unsupported. Furthermore, in the typical action or recliner chair of traditional configuration, there is an open gap between the chair seat and footrest when the footrest is in the extended position. This gap can be aesthetically displeasing, primarily because the footrest actuating linkage mechanism is exposed in this gap.

In order to eliminate the gap between the seat and the extended footrest, it has been suggested that the seat upholstery extend continuously from the seat and over a legrest connected directly to the seat so as to eliminate any unsightliness therebetween. Such a teaching may be found for example in U.S. Pat. No. 27,645 patented Mar. 27, 1860. According to the disclosure of this patent, a legrest is pivoted relative to the seat and is movable between upright and declined positions. In order to take up slack in the upholstery which occurs as the legrest is raised this patent passes the upholstery over a slide mounted roller on the underside of the legrest before attaching it to the underside of the legrest. By moving the slide mounted roller in synchronization with pivotal movement of the legrest, the upholstery is maintained taut.

Another approach to eliminating the unslightly gap between the footrest and seat of a recliner when the footrest is extended is disclosed in U.S. Pat. No. 4,915,444. According to the disclosure of this patent, a continuous length of cushioned upholstery extends from the back of the seat and over the footrest. When the footrest of this patent is retracted, the continuous layer of upholstery is convexedly formed about the front of the chair and folded back underneath the chair as the footrest is moved into its fully retracted position beneath the chair. In other words, the recliner chair in this patent moves the footrest from an extended position generally horizontally oriented forward of the seat through approximately 180 degrees to a position generally horizontally oriented underneath the chair seat in moving from extended to retracted position and thereby maintains the upholstery taut. While this recliner chair design provides continuous support from chair seat to chair footrest, the 180 degree motion of the footrest requires a complex and relatively expensive linkage mechanism.

It has therefore been an objective of the present invention to provide a recliner chair having a continuous upholstered cushion extending between the chair seat and the footrest, sometimes referred to as a recliner lounger, in which the cushioned upholstery may be maintained in a taut state in all positions of the footrest with a very simple and minimally expensive mechanism to maintain the tautness.

Still another objective of this invention has been to provide a recliner lounger mechanism in which conventional recliner linkage mechanisms may be utilized with a minimum addition to enable those mechanisms to be utilized to manufacture recliner loungers.

SUMMARY OF THE INVENTION

The present invention comprises a recliner chair having a seat and backrest mounted upon a seat and backrest linkage mechanism for movement between upright, partially reclined or TV, and fully reclined position. The recliner further includes a footrest and footrest linkage means operable to effect extension and retraction of the footrest simultaneous with reclining movement of the seat and backrest linkage mechanism. A layer of cushioned upholstery extends from the back of the seat, to, over and around the footrest and is attached to an upholstery tension adjustment linkage means on the underside of the footrest. When the footrest is extended and moved away from the front of the chair, the upholstery tension adjustment linkage is operable to introduce slack into the upholstery so as to permit the footrest to move away from the front of the chair. When the footrest is retracted, the upholstery tension adjustment mechanism is operable to pull the upholstery taut and take up the slack which would otherwise be introduced as a result of movement of the footrest into adjacency with the front of the chair.

The upholstery tension adjustment linkage mechanism is connected between the conventional footrest actuating scissors linkage and the footrest, and is activated by the scissors linkage. When the recliner chair has the footrest extended and the seat reclined, the tension adjustment linkage mechanism, comprising a pair of links extending between the scissors linkage and the underside of the footrest, moves the end of one link to which the end of the upholstery is attached, toward the underside of the footrest, and when the footrest is retracted, the same end with its attached end of upholstery, is moved away from the underside of the footrest.

The primary advantage of the invention of this application is that it enables very nearly any recliner linkage mechanism to be utilized to manufacture a conventional recliner chair or, with the addition of a few simple links connected between the footrest actuating scissors linkage and its footrest, to be utilized in the manufacture of a recliner lounger, i.e., a recliner in which the upholstered cushion extends between the back of the seat to and over the footrest. This invention also has the advantage of including a recliner lounger to be very inexpensively added to the line of recliners of a manufacturer without the need to tool for a new expensive mechanism.

These and other objects and advantages of the invention will more readily be apparent from the following description of the drawings in which:

DESCRIPTION OF PREFERRED EMBODIMENT

Figures 1, 3:
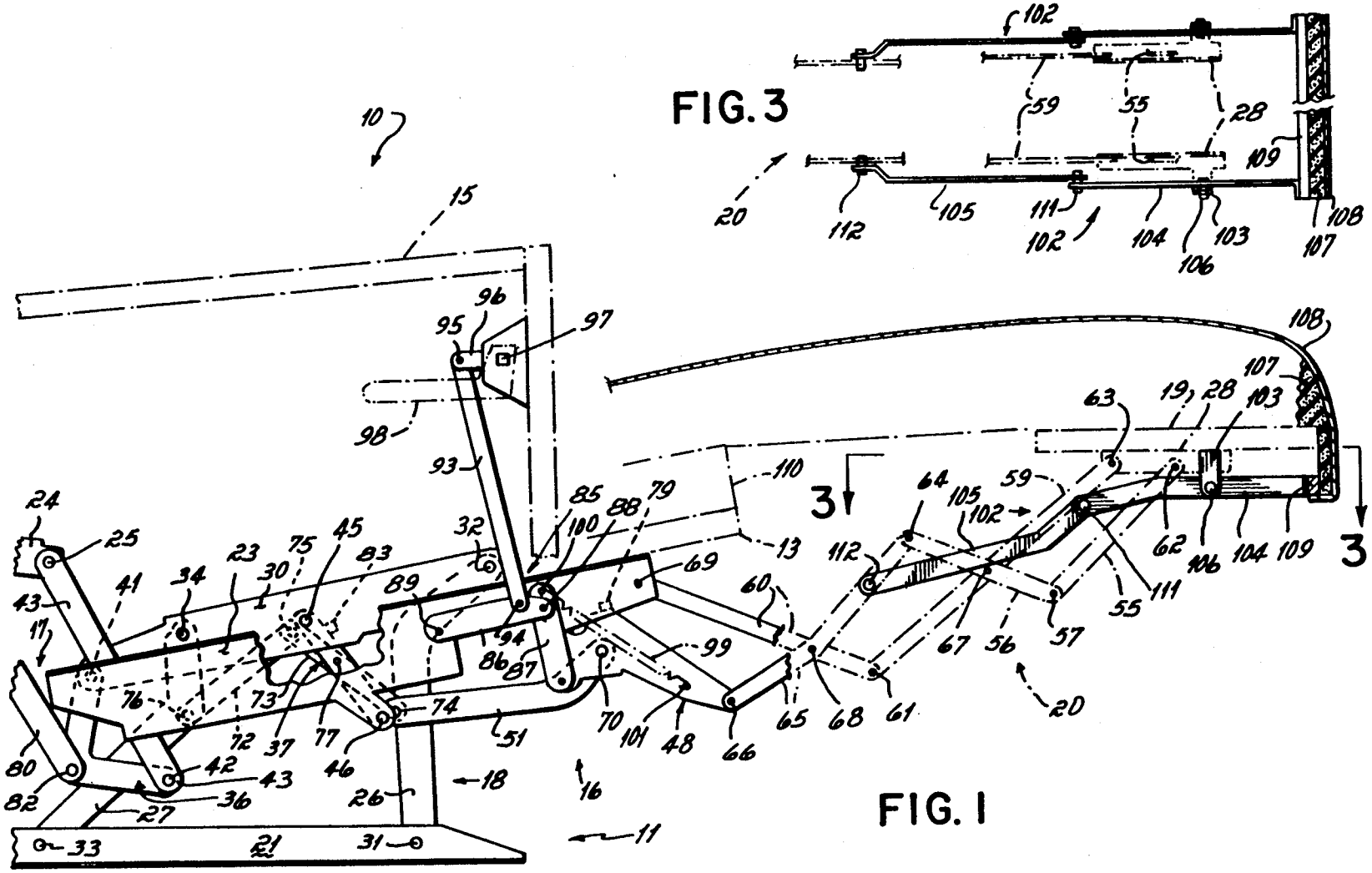
FIG. 1 is a side elevational view of a recliner chair embodying the invention of this application and with the footrest of the chair in the extended position.
FIG. 3 is a top plan view of the upholstery tension adjustment linkage mechanism as viewed on lines 3—3 of FIG. 1.
Figure 2:
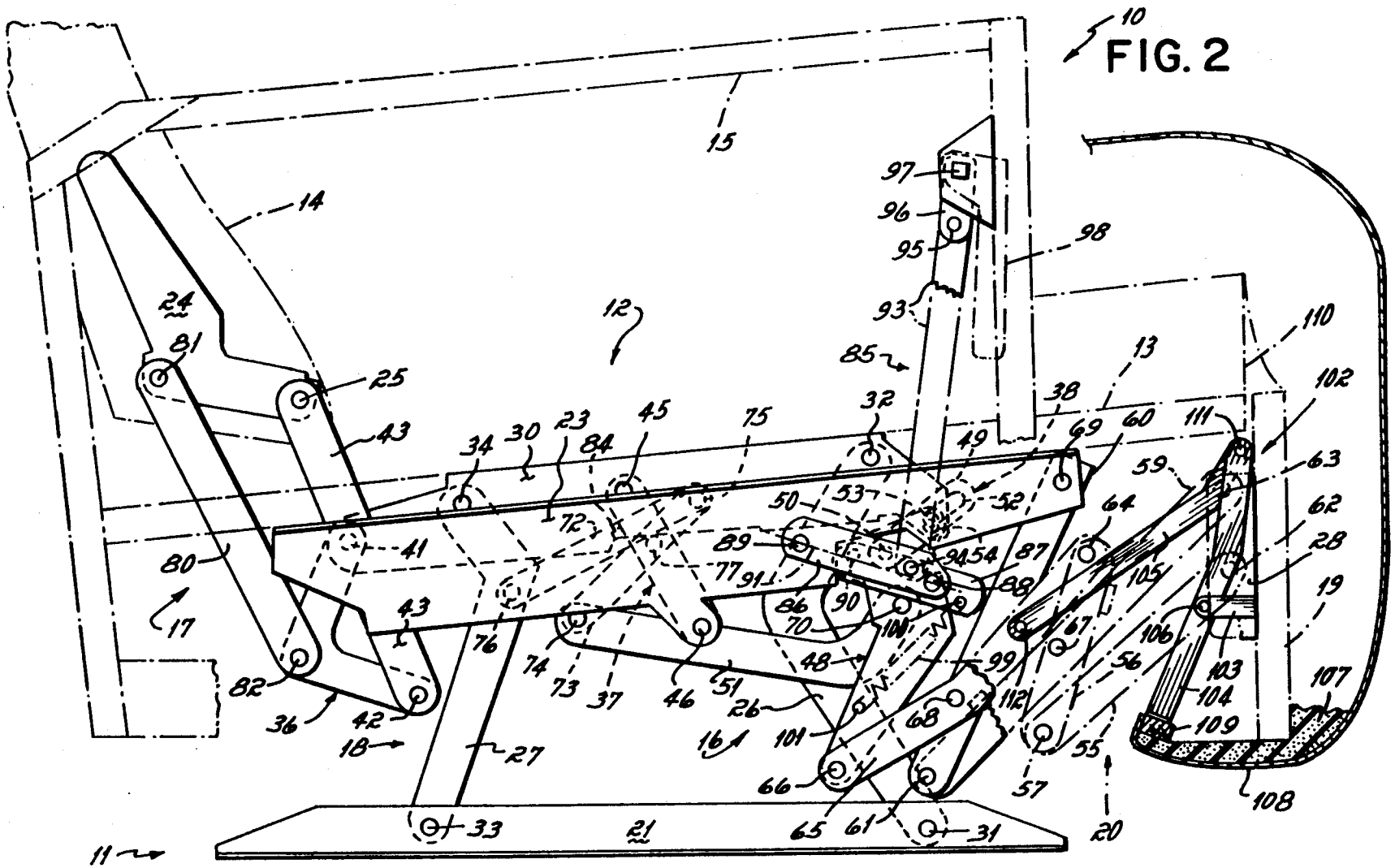
FIG. 2 is a side elevational view of the recliner chair of FIG. 1 but with the footrest in the retracted position.

The reclining chair 10 illustrated in FIGS. 1 through 3 comprises a stationary base 11 and a body support 12 mounted for movement on this stationary base and movable between upright, TV and full reclined positions. The body support 12 includes a seat frame 13 and backrest frame 14 pivotally connected one to the other. The reclining chair 10 also includes an armrest frame 15 on each side of the chair fixedly attached to the seat frame 13. The chair's seat and armrest frames 13, 15 and backrest 14 are mounted on the base 11 and are interconnected one with another through recliner linkage 16, backrest linkage 17, and a supporting four bar linkage 18. The chair also includes a footrest frame 19, footrest linkage assembly 20 and an upholstery tension adjustment linkage assembly 102. The footrest linkage assembly 20 is mounted upon the chair's seat frame 13 so as to be movable therewith. The upholstery tension adjustment linkage assembly 102 is mounted between the footrest linkage assembly 20 and the footrest frame 19 and is actuated by the footrest linkage assembly.

The recliner linkage 16, backrest linkage 17, footrest assembly 20, four bar linkage 18, and upholstery tension adjustment linkage assembly 102 illustrated in FIGS. 1 and 2 are found on each side of the chair 10 even though the structure for only one side, the right side, when considered while sitting in the chair, is shown. In other words, the recliner linkage 16, backrest linkage 17, footrest linkage assembly 20, four bar linkage 18, and upholstery tension adjustment linkage assembly 102 is duplicated on opposite sides of the chair, only one side being shown in the drawings for purposes of illustration. Further, and although the figures only show the framework 13, 14, 15 and 19 for the chair's seat, backrest, arms and footrest, it will be understood that such framework is suitably adapted for receiving appropriate spring elements, cushioning, upholstery, and the like (only a portion of which are shown) for completion of a saleable product. In other words, the springs, cushioning and covering of the chair 10 have been only partially shown in both phantom and solid lines for clarity of illustration in the drawings.

FIG. 2 illustrates the position of the recliner linkage 16, backrest linkage 17, four bar linkage 18, footrest linkage assembly 20, and upholstery tension adjustment linkage assembly 102 when the chair is upright. FIG. 1 illustrates the position of these elements when the chair is in the intermediate or TV position. The chair is also movable to a full reclining position but that position of the chair and its operating mechanism has not been illustrated since it is not necessary for a full understanding of the invention of this application. This full reclining position of the mechanism though is illustrated (absent the tension adjustment linkage assembly 102) in U.S. Pat. No. 4,577,902, the disclosure of which is hereby incorporated by reference.

The reclining chair 10 as previously mentioned, includes a base frame 11 which is comprised of a base plate 21 on each side thereof (only one of which is shown). The base plates are connected one with the other by cross frame members (not shown), thereby providing a generally square or rectangular base frame 11 for the chair 10 that is stationary relative to ground. Each side of the chair also includes a seat frame mounting plate 23 on which the chair's seat frame 13 is fixed and a back frame mounting plate 24 on which the chair's backrest frame 14 is fixed, the backrest 24 and seat frame 23 mounting plates being pivotally connected one to the other at pivot 25 as explained more fully hereinafter. Each side of the chair also includes a footrest frame mounting plate 28 to which the footrest frame 19 is fixed. The seat mounting plate 23, backrest mounting plate 24 and footrest frame mounting plate 28 are all interconnected one with the other by the recliner linkage 16, backrest linkage 17, and footrest linkage 20, all of which are comprised solely of mechanical links.

The seat frame mounting plate 23 is suspended from the four bar linkage 18 which is in turn mounted upon the base support plate 21. The four bar linkage includes the base plate 21, a front leg 26, a rear leg 27, and a carrier plate 30. The front leg is pivotally connected at its lower end to the base plate 21 by a pivot 31 and at its upper end to the front of the carrier plate by a pivot 32. The rear leg 27 is pivotally connected to the base plate 21 by a pivot 33 and at the top to the carrier plate by a pivot 34. The pivotal connections of the legs 26, 27 to the base plate 21 and carrier plate 30 permits the carrier plate to move in a forward and rearward direction relative to the base plate 21 as may be seen in a comparison between the view of FIGS. 1 and 2.

The seat supporting plate 23 is suspended from the carrier plate 30 of the four bar linkage by a pair of hanger links 36, 37 and a sequencing linkage 38. One of the hanger links 36 is located at the rear of the chair while the other 37, is located medially of the length of the seat support plate 23. The rear hanger link 36 is pivotally connected at its upper end to the carrier plate 30 by a pivot 41. At its lower end, it is pivotally connected by a pivot 42 to the lower end of a bracket 43 fixedly attached to the seat support plate 23. Since the bracket 43 is riveted or welded to the seat support bracket 23, it is in effect an extension of the seat support plate 23. Consequently, the rear hanger link 36 effectively pivotally interconnects the carrier plate 30 at the pivot 41 to the seat support plate 23 at the pivot 42. The other hanger link 37 is pivotally connected at its upper end to the carrier plate 30 by a pivot 45 and is pivotally connected at its lower end to the seat support plate 23 by a pivot 46.

At its forward end, the seat supporting plate 23 is connected to the carrier plate 30 by the sequencing linkage 38. This linkage 38 comprises two links, a footrest pivot link 48, and a sequence glide link 49. The footrest pivot link 48 and the sequence guide link 49 are pivotally interconnected one to the other by a pivot 50. The upper end of the sequence link is slotted as indicated at 52 and is connected to the front of the carrier plate 30 by a pivot 53 which extends through the slot 52 of the sequence link 49. The upper end of the footrest pivot link 48 is pivotally connected by a pivot 54 to the seat supporting plate 23.

The footrest linkage assembly 20 is in the form of a double-V, lazy tong linkage of the conventional overlapped style. The footrest linkage assembly 20 includes links 55, 56 that form a front V-pair pivotally interconnected by a pivot 57, and links 59, 60 that form a rear V-pair pivotally interconnected by a pivot 61. The front links 55, 59 of each V-pair are pivotally connected by pivots 62, 63 respectively at their free ends to the footrest frame mounting plate 28 and hence, to footrest frame 19. The rear link 56 of the front V-link pair 55, 56 is connected by a pivot 64 to the forward end of a third V-link pair 65, 48 of the footrest linkage. This third V-pair 65, 48 are pivotally interconnected at their ends by a pivot 66. The first V-pair 55, 56 are connected to the second V-pair 59, 60 by a pivot 67 which extends through the links 56, 59 medially of the length of the links and the second pair is connected to the third V-pair by a pivot 68 which extends through the links 60, 65 at a point medially of the ends of these two links. The upper ends of the links 60, 48 are pivotally connected to the seat support plate 23 by pivots 69, 54 respectively.

The upholstery tension adjustment linkage assembly 102 is comprised of a pair of mechanisms located on opposite ends of the footrest frame, each mechanism 102 includes a bracket 103 mounted to the inside surface of footrest frame 19, a first link 104 and a second link 105. First link 104 is pivotally connected to bracket 103 by a pivot 106 located medially along the length of the first link 104. Referring now to FIG. 2, the lower end of the first link 104 is connected to the ends of cushion 107 and upholstery 108 via a small wooden block 109. As can be seen, cushion 107 and upholstery 108 extend forward past the lower edge of footrest frame 19, up, over, and around the outer surface of footrest frame 19, and onto seat cushion 110. The upper end of first link 104 is pivotally connected to the upper end of second link 105 by pivot 111. The lower end of second link 105 is depicted as being pivotally connected by pivot 112 to the front link 65 of the third V-pair of links, hereinabove described, although it should be recognized that second link 105 could be connected to any suitable link of any other suitable footrest linkage assembly. FIG. 3 demonstrates that each of the pair of mechanisms making up upholstery tension adjustment linkage assembly 102 is mounted outboard of each half of footrest linkage assembly 20.

Actuation of the footrest from retracted to extended position occurs as a consequence of forward movement of the rear leg 27 from the position illustrated in FIG. 2 to the position illustrated in FIG. 1. To this end the rear leg 27 is connected to the footrest pivot link 48 via a rear leg drive link 72, a footrest drive pivot link 73 and a footrest actuating link 51. The footrest actuating link 51 is connected by pivot 70 to the footrest pivot link 48. The opposite end of the footrest actuating link 51 is connected by a pivot 74 to the lower end of the footrest drive pivot link 73. The upper end of the footrest drive pivot link 73 is connected by a pivot 75 to the forward end of the rear leg drive link 72, the rear end of which is pivotally connected by a pivot 76 to the upper end of the rear leg 27. The footrest drive pivot link 73 is pivotally connected by a pivot 77 intermediate of its ends to the hanger link 37.

Actuation of the footrest from retracted to extended position necessarily actuates upholstery tension adjustment linkage assembly 102. As the footrest moves from the retracted position of FIG. 2 to the extended position of FIG. 1, the span between the front edge of seat cushion 110 and the back edge of footrest frame 19 increases. At the same time, the motion of upholstery tension adjustment linkage mechanism 102 is such that the end of first link 104 to which is attached cushion 107 and upholstery 108 moves toward and begins to approach the underneath side of footrest frame 19. As this occurs, cushion 107 and upholstery 108 move upwardly, overly, and with respect to footrest frame 19. The motion of first link 104 thereby allows cushion 107 and upholstery 108 to move upwardly, overly, and rearwardly of footrest frame 19, thereby spanning the increasing distance between the front edge of seat spring 110 and the rear edge of footrest frame 19. In the fully extended position, then, as is seen in FIG. 1, it is apparent that the excess of cushion 107 and upholstery 108 in FIG. 2, between the end of first link 104 and foot frame 19, has been utilized to create a continuous support of upholstered cushion between the chair seat and footrest. In the reverse operation wherein the footrest moves from the extended position to the retracted position, first link 104 gently pulls cushion 107 and upholstery 108 downwardly, overly, and rearwardly of footrest frame 19, thereby rendering cushion 107 and upholstery 108 in a taut condition, the result being a smooth curvature of cushion 107 and upholstery 108 extending from seat, around footrest, and below seat in a pleasing manner.

With reference to FIGS. 1 and 2, it will be seen as the chair moves from the upright to the reclined position, the top of the rear leg 27 swings forwardly and downwardly. This motion has the effect of pulling the upper end of the rear leg drive link 72 rearwardly, thereby causing the footrest drive pivot link 73 to rotate in a counterclockwise direction about the pivot 77. This results in the lower end of the footrest drive pivot link 73 moving forwardly, thereby propelling the footrest pivot link 48 forwardly. As the footrest pivot link is driven forwardly it causes the scissor linkage of the footrest linkage assembly 20 to open, thereby propelling the footrest frame mounting plate 28 forwardly to the fully opened position depicted in FIG. 1. This forward movement of the footrest linkage assembly 20 is terminated when the top surface of the footrest pivot link 48 contacts a stop 79 (FIG. 1) of the seat support plate 23.

As mentioned hereinabove, the back frame mounting plate or backrest mounting plate 24 is pivotally connected to the seat support plate 23 by a pivot 25 in the seat support plate bracket 43. Since the bracket 43 is fixedly secured to and forms a part of the seat support plate 23, the pivot 25 acts as a pivot between the backrest support plate 24 and seat support plate 23. The backrest mounting plate 24 is also connected to the lower end of the seat support plate bracket 43 through a full recline drive link 80 and the rear hanger link 36. The full recline drive link 80 is pivotally connected at its upper end by a pivot 81 to the backrest mounting plate 24 and at its lower end by a pivot 82 to the bellcrank shaped rear hanger link 36.

Rearward pivotal movement of the backrest mounting plate 24 about the pivot 25 is effected by a person seated in the chair leaning back against the backrest frame 14. Assuming the chair is in the upright position of FIG. 2, a rearward force upon the frame 14 is transmitted to the backrest mounting plate 24 thereby causing the plate 24 to rotate in a counterclockwise direction as viewed in FIGS. 1 and 2 about the pivot 25. This results in the full recline drive link 80 moving downwardly thereby driving the lower end of the hanger link 36 forwardly and upwardly as the hanger link pivots about its upper pivot 41. Since the lower end of the hanger link 36 is pivotally attached to the bracket 43 and through the bracket 43 to the seat supporting plate 23, this movement of the hanger link 36 propels the seat supporting plate forwardly and upwardly about the hanger links 36, 37 by which it is suspended from the carrier plate 30. This forward and upward movement of the seat support plate 23 continues until a front surface of the hanger link 37 abuts a stop 83 on the carrier plate 30.

To return the chair from the full recline position (not shown) to the TV position (FIG. 1) the occupant of the chair need only move his shoulders forwardly so as to release the force against the backrest frame 14. The weight of the occupant in the chair then causes the seat mounting plate 23 to move downwardly and rearwardly about the hanger links 36 and 37 until the rear surface of the hanger link 37 engages a stop 84 on the carrier plate 30. Simultaneously, the pivot 53 movable in the slot 52 of the sequence link engages the end of the slot 52 further acting as a stop to prevent any further downward and rearward movement of the seat support plate 23 relative to the carrier plate 30.

Because the four bar mechanism 16 of this chair 10 is weight biased forward when the chair is in the upright position, a weight of downward force on the seat acts through the recliner linkage 16 to apply a downward force upon the carrier plate 30 and, in the absence of a latch or lock, to move the carrier plate 30 downwardly and forwardly. A latch must therefore be provided to retain the chair in the upright position when a person is seated in it. Absent such a latch the chair would automatically move from the upright position (FIG. 2) to the TV position (FIG. 1) when a person sat down in the chair. To that end this chair includes a handle operated latch mechanism 85 operable between the footrest linkage assembly 20 and the seat support plate 23 to hold the chair in an upright position with the footrest linkage assembly closed with the footrest frame 19 located adjacent the seat frame 13. This latch mechanism 85 comprises a pair of footrest locking links 86, 87 and a handle actuated lock release link 93. The footrest locking links 86, 87 are movable to an on or over-center position to lock the footrest relative to the seat supporting plate 23. When the footrest is locked in a closed position, the four bar linkage 18 is similarly locked against movement from the upright to the TV position. The locking of the four bar linkage occurs as a consequence of the rear leg 27 of the four bar linkage being secured to the footrest linkage 20 through a footrest actuating link 51, the footrest drive pivot link 73, and the rear drive link 72. Thus, so long as the footrest remains locked against movement relative to the seat support plate 23, the chair cannot move from the upright to the TV position.

The footrest locking links 86, 87 are pivotally interconnected by a pivot 88. The locking link 86 is pivotally connected to the seat support plate 23 at the end remote from the pivot 88 by a pivot 89. The end of the locking link 87 remote from the pivot 88 is connected to the footrest pivot link 48 by a pivot 90.

When the footrest linkage assembly 20 is in a closed position illustrated in FIG. 2, the pivot 90 between the locking link 87 and the footrest pivot link 48 is located beneath the footrest locking link 86 and either in line with a center line 91 drawn through the pivots 88, 89 or slightly above that center line. In order for the footrest linkage to move outwardly, the pivot 90 must move downwardly relative to the center line 91. Absent some external force though to effect that movement, the footrest linkage assembly 20 will remain locked in a closed position relative to the seat support plate 23. To effect relative movement between the links 86, 87 so as to locate the pivot 90 beneath the locking plane 91 (so as to permit the footrest linkage assembly to open) a handle operated lock release link 93 is pivotally attached at one end by a pivot 94 to the locking link 86. The opposite end of the link lock release 93 is pivotally connected by a pivot 95 to a handle link 96. This handle link 96 is fixedly attached to a handle shaft 97 which is in turn secured to a handle 98. When the handle is rotated in a clockwise direction as illustrated in FIGS. 1 and 2, it has the effect of moving the lock release upwardly, thereby pulling the locking link 86 upwardly to locate the pivot 90 below the centerline 91 extending between the pivots 88, 89. As soon as the locking link 86 has moved a sufficient distance, usually a small fraction of an inch, so as to locate the pivot 90 beneath the centerline 91, the footrest linkage is free to move outwardly to an extended position.

In order to assist in holding the locking links 86, 87 in a locked position, a spring 99 extends between a stop 100 on the locking link 87 and a pin 101 extending from the footrest pivot link 48. As may be seen in FIG. 2, this spring 99 tends to bias the end of the link 87 remote from the pivot 90 downwardly when the linkage is in a closed position, thereby holding the pivot 88 between the two links 86, 87 downwardly against accidental or inadvertent movement. Thus, the spring assists in holding the footrest linkage assembly 20 in a latched closed position. And, so long as the footrest assembly is locked in a closed position, the four bar linkage 18 is restrained against any movement.

While I have described one preferred embodiment of my invention relative to one specific recliner linkage mechanism, persons skilled in the art will appreciate that my invention includes any conventional recliner linkage to be utilized in a recliner lounger, i.e., a recliner chair having the upholstery extending from the back of the chair seat to and over the footrest. Therefore, I do not intend for my invention to be limited except by the scope of the following appended claims.

I claim:

1. A recliner chair comprising a base, a seat and backrest, a footrest having an inner side edge and an outer side edge, seat and backrest linkage means including a seat link mounting said seat to said base for movement of said seat and backrest between upright and reclined positions, and linkage means being operable to change the inclination of said seat in the course of movement between upright and reclined positions, footrest linkage means mounting said footrest to said seat, said footrest linkage means being operable to move said footrest between retracted and extended positions, said retracted position disposing said footrest generally vertically and with the inner side edge located adjacent to said seat, said extended position disposing said footrest generally horizontally and with said inner side edge spaced substantially forward of said seat, upholstery tension adjustment linkage means, and a layer of upholstery overlying and fixed to said seat, said upholstery extending continuously to, over, and around said footrest and being connected to said upholstery tension adjustment linkage means for adjusting movement of said layer of upholstery relative to said footrest in response to extension and retraction of said footrest.

2. The recliner chair of 1 wherein said upholstery tension adjustment linkage means is connected between said footrest and one of said footrest linkage means or said seat and backrest linkage means, said upholstery tension adjustment linkage means being operable to maintain said upholstery taut in all positions of said footrest during said footrest's travel between said retracted and extended positions.

3. The recliner chair of 1 wherein said footrest has an upper surface and a lower surface in said extended position of said footrest, said upholstery tension adjustment linkage means being operable to cause said upholstery to recede upwardly and rearwardly relative to said footrest's upper surface as said footrest is moved from said retracted position to said extended position, and to cause said upholstery to advance downwardly and forwardly relative to said footrest's upper surface as said footrest is moved from said extended position to said retracted position.

4. The recliner chair of 1 wherein said footrest linkage means comprises a pair of scissors linkage mechanisms located on opposite sides of said chair and interconnecting said footrest and said seat and backrest linkage means, each of said scissors linkage mechanisms including a pair of links pivotly connected to said footrest and at least one link pivotly connected to the forward end of said seat link.

5. The recliner chair of 4 wherein said footrest has an upper surface and a lower surface in said extended position of said footrest, said upholstery tension adjustment linkage means comprising a pair of upholstery tension adjustment linkage mechanisms, each of said tension adjustment linkage mechanisms comprising a bracket fixedly attached to said footrest's lower surface, a first link pivotally connected to said bracket medially along said first link's length, a second link, said second link having a front end pivotally connected to a rear end of said first link, said second link having a rear end pivotally connected to a link of said scissors linkage, and said upholstery layer having an end connected to one end of said first link.

6. The recliner chair of 4 wherein said footrest has an upper surface and a lower surface in said extended position of said footrest, said upholstery tension adjustment linkage means comprising a pair of upholstery tension adjustment linkage mechanisms, each of said tension adjustment linkage mechanisms comprising a bracket fixedly attached to said footrest's lower surface, a first link pivotally connected to said bracket medially along said first link's length, a second link, said second link having a first end pivotally connected to a second end of said first link, said second link having a second end pivotally connected to a link of said scissors linkage, and said upholstery layer having an end connected to a first end of said first link.

7. A recliner chair movable between upright and inclined positions, said chair comprising a base, a seat and backrest, a footrest having an inner side edge and an outer side edge, a seat and backrest linkage including a seat link mounting said seat to said base for movement of said seat and backrest between upright and reclined positions, said seat and backrest linkage being operable to change the inclination of said seat as said chair is moved between upright and reclined positions, a footrest linkage mounting said footrest to said seat, said footrest linkage being operable to move said footrest between retracted and extended positions, said retracted position disposing said footrest with said inner side edge located generally adjacent to said seat, said extended position disposing said footrest generally horizontally and with said inner side edge spaced substantially forward of said seat, a layer of upholstery overlying and fixed to said seat, said upholstery extending from said seat continuously to, over, and around said footrest, an upholstery tension adjustment means including an upholstery tension adjustment linkage, said upholstery tension adjustment linkage being operable to effect movement of said layer of upholstery relative to said footrest in response to extension and retraction of said footrest so as to maintain said upholstery taut as said footrest is moved toward and away from said seat in the course of movement between retracted and extended positions of said footrest.

8. The recliner chair of 7 wherein said upholstery tension adjustment linkage is connected between said footrest and one of said footrest linkage or said seat and backrest linkage.

9. The recliner chair of 7 wherein said footrest has an upper surface and a lower surface in said extended position of said footrest, said upholstery tension adjustment linkage being operable to cause said upholstery to recede upwardly and rearwardly relative to said footrest's upper surface as said footrest is moved from said retracted position to said extended position, and to cause said upholstery to advance downwardly and forwardly relative to said footrest's upper surface as said footrest is moved from said extended position to said retracted position.

10. The recliner chair of 7 wherein said footrest linkage comprises a pair of scissors linkage mechanisms located on opposite sides of said chair and interconnecting said footrest and said seat and backrest linkage means, each of said scissors linkage mechanisms including a pair of links pivotly connected to said footrest and at least one link pivotly connected to the forward end of said seat link, and said upholstery tension adjustment linkage comprising at least a pair of links, one of said pair of links of said tension adjustment linkage being connected to said footrest and the other of said pair of links being connected to one of said scissors linkage mechanisms.

11. The recliner of claim 10 wherein one end of said layer of upholstery is connected to said one link of said tension adjustment linkage.

12. The recliner chair of 10 wherein said footrest has an upper surface and a lower surface in said extended position of said footrest, said upholstery tension adjustment linkage comprising a bracket fixedly attached to said footrest's lower surface, a first link pivotally connected to said bracket medially along said first link's length, a second link, said second link having a front end pivotally connected to a rear end of said first link, said second link having a rear end pivotally connected to a link of one of said scissors linkage mechanisms, and said upholstery layer having an end connected to one end of said first link.

13. In a recliner chair of the type having a seat and a footrest, which footrest has an inner edge and an outer edge, the seat being movable between a generally horizontal position and an inclined position as the footrest is moved between retracted and extended positions, said chair having a layer of upholstery extending continuously from the seat to, over, and around the footrest, a method of continuously maintaining said layer of upholstery in a taut condition as said footrest travels from a retracted position in which said seat is generally horizontal and said footrest is located generally in a vertical orientation with said inner edge of said footrest located adjacent said seat to an extended position in which said seat is inclined and said footrest is located generally in a horizontal orientation with said inner edge of said footrest spaced forward of said seat, which method comprises storing a length of excess upholstery on the inside of said footrest when the footrest is located in a retracted position, said length of excess upholstery corresponding generally to the difference in span created between said footrest and said seat when said footrest is moved between said retracted and said extended positions, extending said length of excess upholstery so as to permit said upholstery to move upwardly, overly, and around said footrest as said footrest traverses from said retracted position to said extended position, and pulling said length of excess upholstery so as to permit said upholstery to move outwardly, overly, around, and rearwardly of said footrest as said footrest traverses from said extended position to said retracted position so as to render said upholstery taut in said retracted position of said footrest.

14. The method of claim 13 wherein said footrest has an inside surface when said footrest is in its retracted position and in which said excess upholstery is moved toward and away from said inside surface of said footrest so said excess upholstery is extended and pulled respectively.

15. A chair comprising a base, a seat and backrest, a footrest having an inner edge and an outer edge, footrest linkage means mounting said footrest to said seat, said footrest linkage means being operable to move said footrest between retracted and extended positions, said retracted position disposing said footrest generally vertically and with said inner edge of said footrest located adjacent to said seat, said extended position disposing said footrest generally horizontally and with said inner edge of said footrest spaced substantially forward of said seat, upholstery tension adjustment linkage means, and a layer of upholstery overlying and fixed to said seat, said upholstery extending continuously to, over and around said footrest and being connected to said upholstery tension adjustment linkage means for adjusting movement of said layer of upholstery relative to said footrest in response to extension and retraction of said footrest.

16. The chair of claim 15 wherein said upholstery tension adjustment linkage means is connected between said footrest and said footrest linkage means, said upholstery tension adjustment linkage means being operable to maintain said upholstery taut in all positions of said footrest during said footrest's travel between said retracted and extended positions.

17. The chair of claim 15 wherein said footrest has an upper surface and a lower surface in said extended position of said footrest, said upholstery tension adjustment linkage means being operable to cause said upholstery to recede upwardly and rearwardly relative to said footrest's upper surface as said footrest is moved from said retracted position to said extended position, and to cause said upholstery to advance downwardly and forwardly relative to said footrest's upper surface as said footrest is moved from said extended position to said retracted position.

18. The chair of claim 15 wherein said footrest linkage means comprises a pair of scissors linkage mechanisms located on opposite sides of said chair and interconnecting said footrest and said seat, each of said scissors linkage mechanisms including a pair of links pivotally connected to said seat and at least one link pivotally connected at the forward end of said seat.

19. The chair of claim 18 wherein said footrest has an upper surface and a lower surface in said extended position of said footrest, said upholstery tension adjustment linkage means comprising a pair of upholstery tension adjustment linkage mechanisms, each of said tension adjustment linkage mechanisms comprising a bracket fixedly attached to said footrest's lower surface, a first link pivotally connected to said bracket medially along said first link's length, a second link, said second link having a front end pivotally connected to a rear end of said first link, said second link having a rear end pivotally connected to a link of said scissors linkage, and said upholstery layer having an end connected to one end of said first link.

20. The chair of claim 18 wherein said footrest has an upper surface and a lower surface in said extended position of said footrest, said upholstery tension adjustment linkage means comprising a pair of upholstery tension adjustment linkage mechanisms, each of said tension adjustment linkage mechanisms comprising a bracket fixedly attached to said footrest's lower surface, a first link pivotally connected to said bracket medially along said first link's length, a second link, said second link having a first end pivotally connected to a second end of said first link, said second link having a second end pivotally connected to a link of said scissors linkage, and said upholstery layer having an end connected to a first end of said first link.

* * * * *